United States Patent [19]

Such

[11] 4,261,568

[45] Apr. 14, 1981

[54] METHOD OF PLAYING A BOARD GAME AND APPARATUS THEREFOR

[76] Inventor: Joseph Such, 5419 W. Drummond Pl., Chicago, Ill. 60639

[21] Appl. No.: 951,556

[22] Filed: Oct. 16, 1978

[51] Int. Cl.[3] ..... A63F 7/07

[52] U.S. Cl. ..... 273/85 R

[58] Field of Search ..... 273/85 R, 85 A, 85 B, 273/126 R

[56] References Cited

U.S. PATENT DOCUMENTS

| | | | |
|---|---|---|---|
| 2,159,966 | 5/1939 | Dunham | 273/126 R |
| 2,828,739 | 2/1958 | Frank | 273/85 R X |
| 3,913,918 | 10/1975 | Trachtman | 273/126 R |

FOREIGN PATENT DOCUMENTS

| | | | |
|---|---|---|---|
| 935252 | 2/1948 | France | 273/85 R |
| 1049658 | 8/1953 | France | 273/85 R |
| 1421034 | 11/1965 | France | 273/85 R |
| 495817 | 6/1954 | Italy | 273/85 R |
| 211511 | 9/1940 | Switzerland | 273/85 R |
| 11037 | of 1890 | United Kingdom | 273/85 R |
| 22934 | of 1901 | United Kingdom | 273/85 R |
| 336188 | 10/1930 | United Kingdom | 273/85 R |
| 486047 | 5/1938 | United Kingdom | 273/85 R |
| 537316 | 6/1941 | United Kingdom | 273/85 R |

OTHER PUBLICATIONS

Ric-O-Chet Hockey 12–1970.

*Primary Examiner*—Paul E. Shapiro
*Attorney, Agent, or Firm*—Bernard L. Kleinke

[57] ABSTRACT

A method and apparatus for playing a board game includes a substantially flat playing board having a playing surface thereon, the playing surface having indicia thereon including target indicia. A ball indicating disc, and first and second player indicating discs used by opposing players are placed on the playing surface in accordance with the game rules. At least one manually operated disc propelling device is used to hit sharply one of the player discs to propel it into engagement with the ball indicating disc, which, in turn, is then driven toward the target indicia. One of the player discs has flat upper and lower surfaces, and the upper surfaces are at least partially rough in texture. The ball indicating disc has a flat lower surface so that the ball indicating disc can be stacked on top of one of the player indicating discs in accordance with the game rules following certain game situations and loosely held in place by frictional engagement therewith, whereby the device can be used to hit the vertically stacked discs with the device to cause the stacked discs to slide along the playing surface.

5 Claims, 6 Drawing Figures

FIG. 1
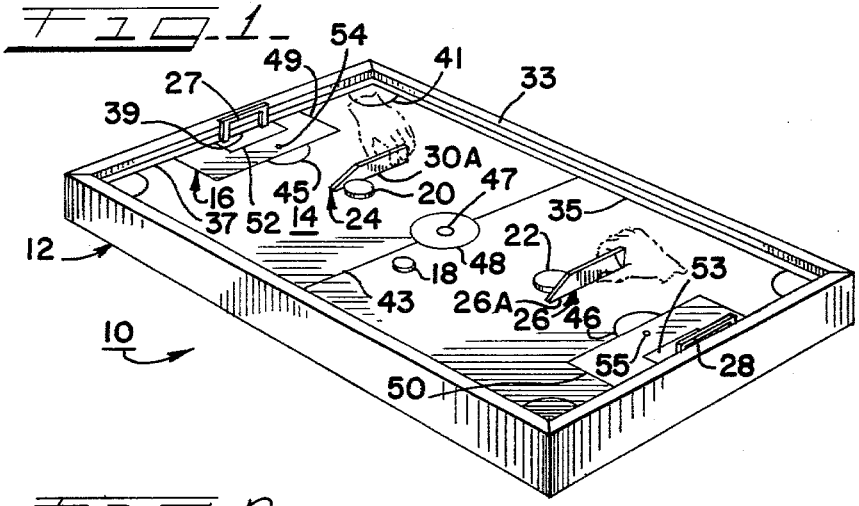
FIG. 2
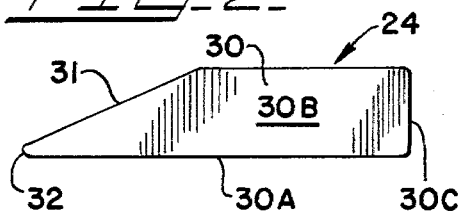
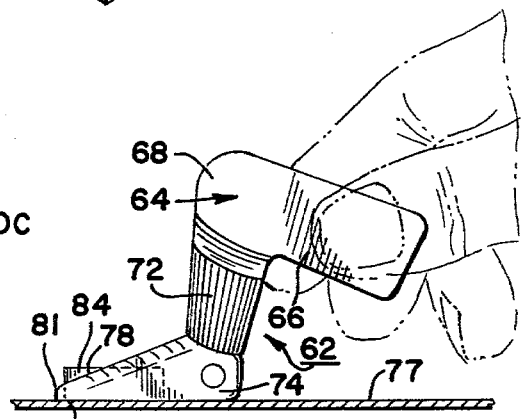
FIG. 5
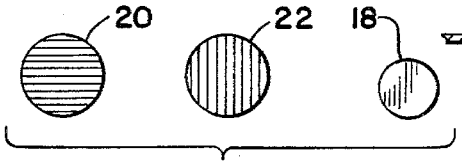
FIG. 3
FIG. 4
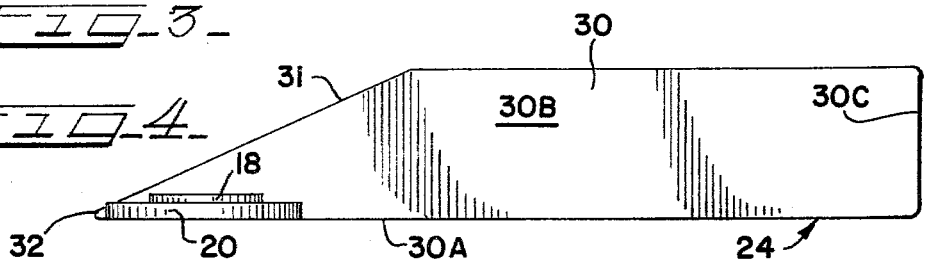
FIG. 6
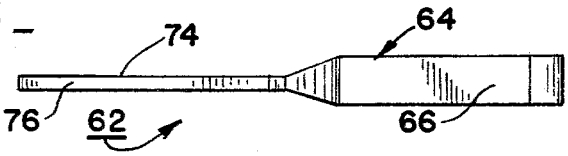

METHOD OF PLAYING A BOARD GAME AND APPARATUS THEREFOR

BACKGROUND OF THE INVENTION

The present invention relates in general to a board game and a method of playing it, and the invention more particularly relates to a method and apparatus for a board game, which simulates an actual game of soccer or the like.

Many different types and kinds of board games have been constructed to simulate other athletic games, such as soccer, hockey, football and the like games. In connection with such types of board games and the like, reference may be made to the following U.S. Pat. Nos.: 2,824,739; 3,554,549; 3,785,648; 3,806,119; and 4,060,245. While the games and devices shown in the foregoing-mentioned patents may have been entertaining for some applications, it would be highly desirable to have an even more entertaining game which requires a higher level of skill by the players. Such a game and method of playing it should require both skill and tactics by the players, and should require manual dexterity on the part of the players. Also, such a game and method of playing it should include apparatus and methods which enable unexpected occurrences to take place so as to more closely approximate actual playing conditions of a full-scale athletic game.

Therefore, it is the principal object of the present invention to provide a new and improved board game apparatus and a method of playing it to provide a more entertaining and a more realistic simulation of a full-scale athletic game.

Briefly, the above and further objects of the present invention are realized by providing a method and apparatus for playing a board game, which includes a substantially flat playing board, and a series of discs positioned on the playing surface of the playing board. The discs include a ball indicating disc and first and second player indicating discs used by opposing players to simulate the actual players of an athletic game, which in the preferred form of the present invention is a soccer game. At least one manually operated disc propelling device is used to hit sharply one of the player discs to propel it along the playing surface into engagement with the ball indicating disc which, in turn, is then driven toward the target indicia on the playing surface of the playing board. The player discs have upper and lower surfaces, and the upper surfaces are at least partially rough in texture. The ball indicating disc has a flat lower surface so that the ball indicating disc can be stacked loosely on top of one of the player indicating discs during certain game situations, such as a goal kick, in accordance with the game rules and loosely held in place by frictional engagement therewith, whereby the device can be used to propel the vertically stacked discs to cause them to slide along the playing surface. Such a manipulation requires dexterity to control the movement of the two discs. Also, the stacked discs may or may not move as a unit together, and thus they may come to rest at different random locations, thereby causing the game to more closely simulate an actual full scale athletic game.

BRIEF DESCRIPTION OF THE DRAWINGS

These and other objects of the present invention will become apparent to those skilled in the art by reference to the following detailed description when taken in conjunction with the accompanying drawings, wherein:

FIG. 1 is a perspective view of the game apparatus of the present invention;

FIG. 2 is a greatly enlarged plan view of a disc propelling device of the game of FIG. 1;

FIG. 3 is a plan view of the player and ball discs of the game of FIG. 1;

FIG. 4 is an elevational view of the device of FIG. 2 in the process of hitting the ball disc stacked vertically upon one of the player discs in accordance with the game rules;

FIG. 5 is a plan view of a disc propelling device of another game which is also constructed in accordance with the present invention; and FIG. 6 is a side elevational view of the device of FIG. 5.

DETAILED DESCRIPTION

Referring now to the drawings, and more particularly to FIG. 1 thereof, there is shown a board game 10 which is constructed in accordance with the present invention, and which is adapted to simulate an actual game of soccer. While the preferred form of the game of the present invention is a simulated soccer game, it will become apparent to those skilled in the art after becoming acquainted with the subject invention that the game of the present invention may be so constructed and arranged to simulate other athletic games as well. The game 10 includes a playing board having a flat planar playing surface 14. A playing indicia generally indicated at 16 on the playing surface 14 facilitates the playing of the game in accordance with the game rules and is arranged to closely approximate the field markings on an actual soccer field.

The game 10 includes a ball indicating disc 18, and a pair of player indicating discs 20 and 22 which are used by opposing players of the game 10. During the playing of the game 10, the player and ball discs are positioned on the playing surface 14. A pair of disc propelling devices 24 and 26 referred to as "kickers" are held by the hand of the players as indicated in phantom lines in FIG. 1 of the drawings.

As hereinafter described in greater detail, in accordance with the game rules, the devices 24 and 26 are used alternatingly by the opposing players to hit sharply their own player disc to propel it along the surface of the playing surface 14 into engagement with the ball indicating disc 18, which, in turn, rebounds therefrom and slides toward the opponent's goal, such as the U-shaped upstanding goals 27 and 28 forming part of the playing indicia 16.

Considering now the propelling devices in greater detail with particular reference to FIG. 2 of the drawings, the device 24 will now be described in greater detail, it being understood that the device 26 is generally similar to it. The device 24 generally comprises a flat elongated bar 30 having a straight bottom playing-surface engaging edge 30A and a sloping end edge or surface 31 terminating at a gently rounded point 32. The device 24 is thin and flat and is composed of generally rigid smooth material, such as a suitable plastic material. The bar 30 has a front face 30B and a rear face (not shown), the front face 30B being used by a left handed player to hit the player piece near the tip or point 32 and the rear face being used by right handed players. The bar 30 is generally rectangular in shape and has a straight end edge or surface 30C opposite the sloping end edge 31. The hand of the player grasps the bar 30 near the straight end edge 30C to hold it in an upright manner and hits the player disc 20 with the front face 30B near the tip or point 32. The sloping or inclined end edge 31 permits the player to see at least a portion of the player disc 20 in preparing to hit the player disc with the device 24. In this regard, a player would ordinarily lean over the playing surface in back of the device 24 and align the device 24 with the disc 20 and the desired final resting position of the disc 20 after the shot is taken. Thus, to help take proper aim, the sloping edge 31 facilitates aiming the device 24 at the disc 20.

As shown in phantom lines in FIG. 1 of the drawings, the device 24 is held by the left hand of the player. In this regard, the device 24 is positioned with its bottom edge 30A flat against the playing surface 14 with the hand grasping the device 24 to the left side of the disc 20 when facing the opposing goal 28.

As shown in FIG. 1 of the drawings, the device 26, which is similar to the device 24, is held by the right hand of the player with the sloping hitting edge surface 26A opposite the player disc 22. In this regard, the hand holds the device 26 with its bottom edge flat against the playing surface 14 in an upright manner with the right hand disposed to the right of the player disc 22 when facing the goal 27. In this regard, the device 26 is used with the right hand of the user to hit the player disc 22 with the sloping or slanted edge 59 of the device 26.

In order to propel the player disc along the playing surface into engagement with the ball disc, the player with a quick flick of the wrist rotates the device about a vertical axis to cause one of the hitting faces of the device to contact the player disc.

Considering now the board 12 in greater detail with reference to FIG. 1 of the drawings, the board 12 includes an upstanding frame or border 33 extending about the periphery of the playing surface 14 to retain the disc on the playing surface. The frame 33 is rectangular in shape.

The playing indicia generally includes a pair of parallel spaced-apart side lines, such as the side line 35, extending in a parallel spaced-apart manner relative to the side portions of the frame 33, to indicate out-of-bounds. A pair of end lines, such as the end line 37, are parallel to and spaced apart from the end portions of the frame 33 to indicate the out-of-bounds for the ends of the playing field. The side and end lines form a rectangularly shaped boundary line for the playing field in a manner similar to the boundary lines for a full scale soccer playing field. When the ball disc strikes the frame 33, it is ruled out-of-bounds.

A pair of goal lines, such as the goal line 39, at the opposite end of the field of play under the goals 27 and 28 co-extensive with the end lines determine, together with the goals 27 and 28, the target areas for scoring points according to the game rules.

The playing indicia further includes quarter circle lines, such as the quarter circle line 41, which are disposed at the four corners of the playing field. A half-way line 43 is disposed on the playing surface and extends transversely thereacross to divide the playing surface 14 into two equal portions. The half-way line extends between the two side lines. A pair of half-circle lines 45 and 46 at opposite ends of the field are used in connection with penalty kicks as hereinafter described in greater detail.

The playing indicia additionally includes a center mark 47 disposed in the center of the field for the purpose of starting the game. A pair of rectangular-shaped penalty areas 49 and 50 are disposed at the opposite ends of the field at the respective goals 27 and 28. Within the respective penalty areas 49 and 50, there are disposed a pair of rectangular goal areas 52 and 53 used in connection with corner kicks according to the game rules and hereinafter described in greater detail. A pair of penalty kick marks 54 and 55 are disposed within the penalty areas 49 and 50, respectively, for use in connection with penalty kicks as hereinafter described in connection with the game rules.

As best seen in FIG. 3 of the drawings, the player discs 20 and 22 are color coded to distinguish them visually, and in this regard the disc 20 is blue in color and the disc 22 is red in color. The discs 20 and 22 are circular in shape.

Considering now the game rules, the rules of the game 10 closely approximate the rules of an actual game of soccer. Two players only may play the game. The game commences by the players choosing which player will use which player disc. Once this is accomplished, the player selecting the blue playing disc initiates the first move of the game. The players take turns at making shots, and each player takes one shot per turn, except for corner kick and foul situations as hereinafter described in greater detail. In these two situations, one of the players is permitted two shots during one turn. In order to complete the game, the player with the highest score at the end of the game is declared the winner.

For the purpose of commencing play of the game, the ball disc 18 is placed on the center mark 47 and the blue player disc 20 is positioned in the circle 48 in direct line with the ball disc 18. The red disc 22 is positioned outside of the circle 48 on the opposite side of the half-way line 43 in any position as desired by the player controlling the red disc 22. The player controlling the blue disc 20 uses the device 24 by placing its bottom edge flat against the playing surface 14 in back of the blue player disc 20 in a manner as indicated in FIG. 1 of the drawings. In this regard, the hand of the player grasps the device 24 as indicated in phantom lines in FIG. 1 and quickly rotates the device 24 about a vertical axis to hit sharply the player disc 20 to slide it along the playing surface 14 and into engagement with the ball disc 18 to drive it toward the opposing player's goal 28 in an attempt to score a point. The red player follows the move by attempting to block, kick out or shoot towards the opposing goal. The player controlling the blue disc alternates therewith using similar strategy.

In order to score a goal, the ball disc 18 must move over the opposing player's goal line under the U-shaped goals 27 and 28 from the same half of the playing field.

A "no-goal" is declared when the ball disc passes the goal line directly from the throw-in as hereinafter described in greater detail. A no-goal is also declared when an offensive player disc moves over a goal line before the ball disc. Similarly, a no-goal situation is declared immediately after a foul as hereinafter described in greater detail. Another situation where a no-goal is determined is where the ball disc slides past the center line. In each one of these no-goal situations, a goal kick is then executed as hereinafter described in greater detail in accordance with the game rules.

A foul is committed when a player disc is hit intentionally by an opposing player disc before contacting the ball disc. A foul is also committed where a player touches the ball disc or a player disc with his hand or other portion of his body, while in play. If a foul is committed, the opposing player is permitted two consecutive moves from the last position.

A "no-foul" ruling is declared when a player disc contacts another player disc when the second player disc is positioned contiguously in engagement with the ball disc.

A penalty kick takes place where a foul is committed in the penalty area by the defensive player only where the infraction takes place in the defensive player's own penalty area. The penalty kick is executed by placing the ball disc on the penalty kick mark of the opposing player's penalty area, and the defensive player's disc on the goal line in the goal area. The offensive player's disc is placed in the half-circle of the penalty area. Both players adjust the final resting position of their player discs behind their hands so as to conceal same from the opposing player. Thereafter, the hands are moved away to reveal the positions of the playing piece, and these playing positions may not change thereafter. The offensive player then takes a move, and if a goal results, the beginning sequence of the game rules is then repeated. If the ball disc stays on the field, the defensive player makes the next move.

A goal kick results when an offensive player hits the ball disc past the end line outside of the goal. A goal kick is executed by firstly returning the offensive player disc to the goal area associated therewith. The other player places the ball disc on his own player disc by vertically stacking them as best seen in FIG. 4 of the drawings. The kicker device is then used to push both the ball disc and the player disc out into the playing field by striking them and causing them both to slide theretoward. A counter move then takes place by the other player.

A corner kick results when the ball disc passes the end line outside the goal post after contacting the player disc defending the goal. In this situation, the defensive player positions his playing disc in the goal area. The offensive player positions the ball disc and his player disc in the corner quarter circle on the same side of the goal where the ball disc passed therethrough. Taking two moves, the player attempts to score.

A throw-in situation occurs where the ball disc passes completely over the side line. The opposing player throws in the ball disc with his hand approximately from the same position but from behind the side line.

A drop ball situation results when a controversial decision occurs. The player who made the last move then drops the ball disc between the two player discs at their last positions so that the other player then takes the next move.

Considering now the goal kick in greater detail, this particular manipulation is used to add interest to the playing of the game. When the ball and the player discs are hit by the disc propelling device to slide them both out into the playing area, the ball disc either remains on top of the player disc after they come to rest or the ball disc falls off of the player disc and they come to rest in different locations in a random manner. In either event, it is very difficult to control the movement of both the ball disc and the player disc when they are stacked so that the opposing player may have a better opportunity at scoring a goal when he takes his next move.

The player discs have flat upper and lower surfaces and are generally circular in plan view as indicated in FIG. 3 of the drawings. The upper surfaces thereof are at least partially rough in texture. The ball indicating disc 18 is generally circular and is white in color. The ball indicating disc 18 has a flat lower surface so that the ball indicating disc can be stacked loosely on top of one of the player indicating discs in accordance with the game rules and be loosely held in position by frictional engagement therewith. Thus, when the disc propelling device is moved into engagement with the vertically stacked discs to hit them with the device to cause them to slide along the playing surface in accordance with the game rules, the ball disc and the player disc may or may not remain in a stacked position depending upon the manual dexterity of the player hitting the stacked discs.

Referring now to FIGS. 5 and 6 of the drawings, there is shown a disc propelling device 62, which forms a part of a board game similar to the game 10, except that the device 62 is used in place of the device 24 and/or the device 26. In this regard, the device 62 serves the same purpose as the device 24, and the device 62 is of a novel foot-and-leg appearance.

The device 62 comprises a body portion 64 generally in the shape of a human leg bent at the knee and painted on its front face to appear like the leg of a soccer player, the rear face (not shown) being painted with a similar design as the front face. The body portion 62 has a thigh portion 66 terminating at a knee portion 68, which, in turn, extends to a calf portion 72 which appears to be stocking covered. A foot portion 74 extends approximately at right angles to the calf portion 72, the upper surface of the body portion 62 being painted to represent a shoe. The shoe or foot portion includes a flat straight bottom edge 76 which serves to engage the playing surface of a playing board 77 in a similar manner as the bottom edge 30A of the device 24. An inclined or sloping end edge 78 serves the same purpose as the sloping edge 31 of the device 24. The edges 76 and 78 converge at a rounded toe portion 81.

As best seen in FIG. 6 of the drawings, the foot portion 74 is thinner than the remaining portion of the device 24 to cause it to be slightly flexible to facilitate hitting the playing disc with a slight whipping motion.

The device 62 is held by the fingers of the user as indicated in phantom lines in FIG. 5 of the drawings. In this regard, the device 62 is held by the thigh portion 66 to support the device 62 in a generally upright manner with the bottom edge 76 flat against the playing surface in position to hit a playing disc 84 by the rear face of the device 62 at the foot portion thereof.

The embodiments of the invention in which an exclusive property or privilege is claimed are defined as follows:

1. A method of playing a board game, comprising:

providing a substantially flat playing board having a playing surface thereon, said playing surface having indicia thereon including target indicia, said playing board including an upstanding frame extending about the periphery thereof for retaining purposes on said playing surface, said indicia including side and end lines on said playing surface enclosing the inbounds location thereof, said side and end lines being spaced apart from the periphery defined by said frame to permit the play to move out-of-bounds within said playing surface at least partially between said side and end lines and said frame at the periphery of said playing surface;

providing a ball indicating disc;

providing first and second player indicating discs to be used by opposing players, each one of the upper surfaces of the player indicating discs being at least partially rough in texture for engaging fictionally the lower surface of the ball indicating disc when it rests on top thereof to enable the ball indicating disc to be carried thereby to move in unison with each other when both are propelled along the playing surface;

providing at least one manually operated disc propelling device;

moving said device into engagement with one of said first and second player indicating discs to hit it sharply therewith to cause it to slide along the playing surface toward the target indicia in accordance with the game rules;

subsequently stacking vertically the ball indicating disc loosely on top of one of the player indicating discs in accordance with the game rules with the player disc positioned in an out-of-bounds location within said playing surface between said side and end lines and said frame; and moving said device into engagement with the vertically stacked discs to hit the stacked discs therewith to cause them to slide along the playing surface in accordance with the game rules over said side and end lines into said inbounds location.

2. A method according to claim 1, wherein said player disc propelling device is composed of substantially rigid material, holding the device in an upright position with its bottom edge flat against the playing surface of the playing board and then rotating it quickly about a vertical axis to cause its opposite end to move into engagement with one of said discs.

3. A method according to claim 1, wherein said device is in the shape of a portion of a human leg and having indicia on at least one face thereof to provide said device with the appearance of a portion of a human leg.

4. A method according to claim 1, wherein said device includes a thinner portion for hitting said discs.

5. A method according to claim 1, wherein said target indicia includes a pair of goal lines co-extensive with said end ends at opposite ends of said playing surface, and a pair of upstanding U-shaped goals positioned over said goal lines at opposite ends of said playing surface.

* * * * *